United States Patent [19]

D'Angelo

[11] 4,201,490

[45] May 6, 1980

[54] TOOTHBRUSH

[76] Inventor: Augustino D'Angelo, 24150 Deanhurst, St. Clair Shores, Mich. 48082

[21] Appl. No.: 940,165

[22] Filed: Sep. 7, 1978

[51] Int. Cl.[2] ..... A46B 11/02

[52] U.S. Cl. ..... 401/175; 401/270; 401/288

[58] Field of Search ..... 401/175, 156, 183, 184–186, 401/270–273, 278, 279, 282, 284, 285, 288, 290, 291

[56] References Cited

U.S. PATENT DOCUMENTS

| | | | |
|---|---|---|---|
| 844,256 | 2/1907 | Curcio | 401/270 |
| 1,486,394 | 3/1924 | Smith | 401/175 |
| 1,596,365 | 8/1926 | Mendoza | 401/270 |
| 2,638,614 | 5/1953 | Anderson | 401/175 |
| 3,141,465 | 7/1964 | Petropoulos | 401/175 |
| 4,071,300 | 1/1978 | Nichols | 401/175 |
| 4,135,831 | 1/1979 | Reitknecht | 401/175 |

FOREIGN PATENT DOCUMENTS

| | | | |
|---|---|---|---|
| 2250576 | 1/1974 | Fed. Rep. of Germany | 401/175 |
| 403582 | 9/1909 | France | 401/175 |
| 435612 | 5/1948 | Italy | 401/175 |
| 440511 | 10/1948 | Italy | 401/175 |
| 501527 | 7/1956 | Italy | 401/175 |
| 1032673 | 6/1966 | United Kingdom | 401/175 |

*Primary Examiner*—Clyde I. Coughenour
*Attorney, Agent, or Firm*—Basile and Weintraub

[57] ABSTRACT

A toothbrush has a shank portion with the brush head carried at one end thereof and a handle at the other end. The shank has a passageway which communicates a paste-holding cavity in the handle to a plurality of bristles mounted on the head end of the toothbrush. The paste-holding cavity of the handle mounts a piston which is axially movable within the paste-holding cavity of the handle in response to a rotatable threaded member so as to compress the paste within the cavity and force the same through the passageway for communication with the bristles. The head has a valve means movable between a first position closing off communication between the passageway and the bristles and a second position permitting such communication.

3 Claims, 11 Drawing Figures

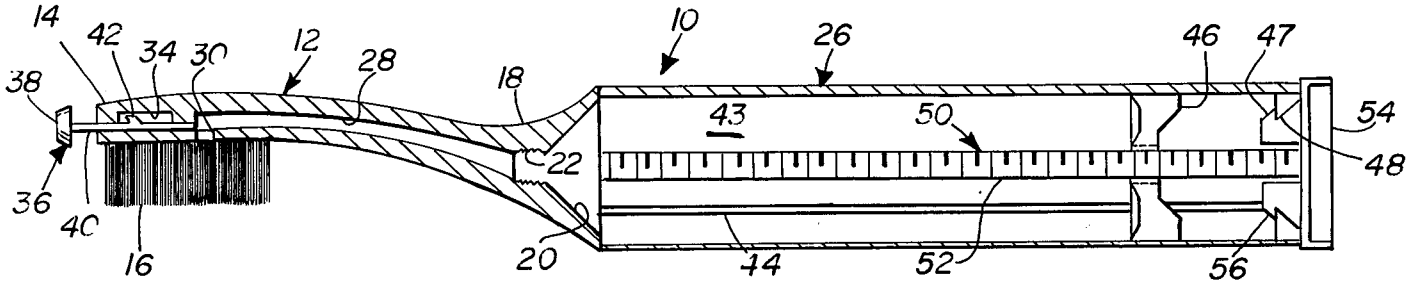
FIG-1
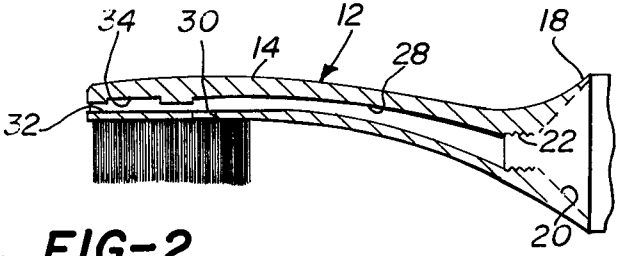
FIG-2
FIG-4
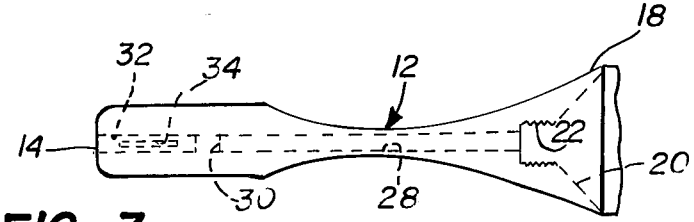
FIG-3
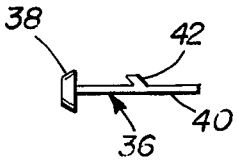
FIG-4A

TOOTHBRUSH

BACKGROUND OF THE INVENTION

1. Field of the Invention

The present invention relates to toothbrushes and, in particular, to a toothbrush having a hollow handle defining a paste-holding cavity wherein toothpaste is forcibly dispensed therefrom through a passageway leading to a bristle equipped head and wherein the head is provided with a valve for selectively opening and closing communication of the paste with the bristles.

2. Description of the Prior Art

It should be appreciated that heretofore toothbrushes of the dispenser type have been disclosed in the prior art. They have included a variety of means for providing for the movement of toothpaste from a dispenser to the bristle area of the toothbrush. In such instances, various proposed types of dispensers are designed to carry varying amounts of toothpaste such that the toothbrush may be used while providing for the convenience of dispensing the toothpaste. Such prior art devices have certain disadvantages which include the clogging of the passageway between the stored toothpaste and the bristles, which may result in the paste becoming stale and hard to use over a given period of time. Examples of prior art apparatuses and devices which are known to applicant are disclosed in U.S. Pat. Nos. 3,256,894; 3,826,580; 4,039,261; 2,081,792; 3,228,057; and 2,750,614.

PRIOR ART STATEMENT

In the opinion of the applicant and applicant's attorneys the above-identified United States patents represent the closest prior art of which applicant and applicant's attorneys are aware.

SUMMARY OF THE INVENTION

The present invention, which will be described subsequently in greater detail, comprises a toothbrush and paste dispensing device including a shank portion having a head with a plurality of bristles and an end portion on which is attached a handle having a paste-holding cavity. The paste-holding cavity includes a manually operated piston arrangement adapted to force toothpaste from the paste-holding cavity to a passageway in the shank portion to communicate the toothpaste to the bristles at the head of the toothbrush. A valve means carried in the head portion of the toothbrush is adapted to selectively open and close communication between the bristles and the paste carrying passageway.

It is therefore an object of the present invention to provide a new and improved toothbrush having a toothpaste dispenser.

It is a further object of the present invention to provide a toothbrush which is simple in design and construction and, thus, of low cost to manufacture.

Other objects, advantages and applications of the present invention will become apparent to those skilled in the art of toothbrushes when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a longitudinal, cross-sectional view through a toothbrush constructed in accordance with the principles of the present invention;

FIG. 2 is a cross-sectional view through the shank and head portion of the toothbrush illustrated in FIG. 1;

FIG. 3 is a top plan view of the shank and head portion of the toothbrush illustrated in FIG. 2 of the drawings;

FIG. 4 is a top plan view of a valve illustrated in FIG. 1 of the drawings;

FIG. 4A is a front elevational view of a valve illustrated in FIG. 4 of the drawings;

DESCRIPTION OF THE PREFERRED EMBODIMENT

Figure 6:
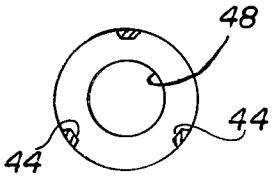
FIG. 6 is a cross-sectional view of the handle taken along Line 6—6 of FIG. 5.
Figure 8:
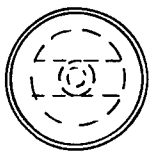
FIG. 8 is a side elevational view of the actuating mechanism illustrated in FIG. 7 of the drawings.

Referring now to the drawings and, in particular, to FIG. 1 wherein there is illustrated one example of the present invention in the form of a toothbrush 10. The toothbrush 10 comprises a shank 12 having a head portion 14, one side of which is provided with a plurality of bristles 16. The other end 18 of the shank 12 has a tapered opening 20 which is threaded at 22 to receive a complementary and matingly shaped end 24 (FIG. 5) of a handle 26, which will be described in greater detail hereinafter.

The opening 20 communicates via a longitudinal passageway 28 to an opening 30 in the head portion of the shank 12 so as to be able to communicate toothpaste, under pressure, through the passageway 28 to the bristles 16. The end section of the head 14 includes a rectangularly shaped guide bore 32 and an enlarged intermediate portion 34. The bore 32 is adapted to slidingly receive a valve member 36. The valve member 36 has a handle end 38 and a rectangularly shaped stem 40. The rectangularly shaped stem 40 is adapted for movement from a first position, as illustrated in FIG. 1 of the drawings, wherein the stem 40 is laterally offset from the opening 30, to a second position wherein the stem 40 is moved to the right, as viewed in FIG. 1 of the drawings, and the stem passes over and closes the opening 30 to prevent further communication of the toothpaste through the opening 30 into the bristles 16. The stem 40 includes a raised tab 42 which is movable within the enlarged section 34. As shown in FIG. 1, the tab 42 abuts the inner wall of the enlarged bore portion 34 to prevent withdrawal of the valve member 36 from the bore 32.

Figure 5:
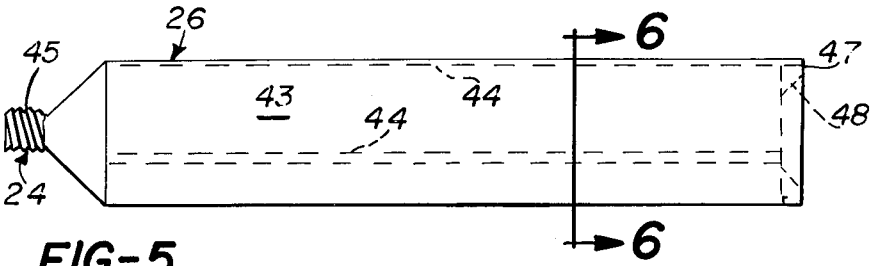
FIG. 5 is a longitudinal, cross-sectional view through the handle portion of the toothbrush illustrated in FIG. 1 of the drawings.
Figure 7:
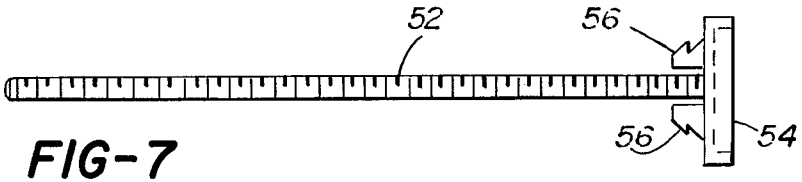
FIG. 7 is a side elevational view of an actuating mechanism illustrated in FIG. 1 of the drawings.

Referring now to FIGS. 5 and 6, it can be seen that the handle 26 has a hollow interior which forms a toothpaste holding cavity 43 which at one end communicates through a threaded end 45 (FIG. 5) to the passageway 28 when the threaded end 45 is received within the threaded bore 22 of the shank 12, as shown in FIG. 1 of the drawings. The handle 26 is cylindrical in shape having a plurality of longitudinally disposed key ways 44 (FIG. 6) which act as a guide for a piston member 46, which will be described hereinafter.

The right end of the handle has a bottom wall 47 with a tapered bore 48 that opens to the interior of the paste-filled cavity 43.

The toothpaste within the toothpaste cavity 43 is forcibly ejected therefrom by means of a piston screw arrangement 50. The screw arrangement 50 includes a threaded support shaft 52 which is affixed at one end in a cantilever fashion to a knob 54. The knob 54 has a pair of diametrically opposed snap members 56. As can best be seen in FIG. 1 of the drawings, when the threaded shaft 52 is inserted in the right opened end of the handle 26, the snap members 56 will snap lockingly engage the inside surface of the wall 47 in the manner shown.

Figure 10:
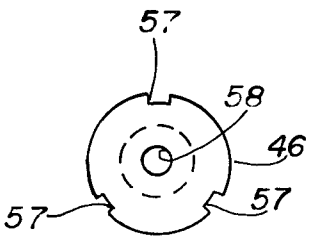
FIG. 10 is a side elevational view of the piston illustrated in FIG. 9 of the drawings.
Figure 9:
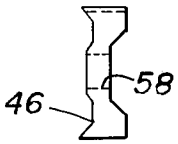
FIG. 9 is a front elevational view of a piston illustrated in FIG. 1 of the drawings.

As can best be seen in FIGS. 9 and 10 of the drawings, the piston 46 is provided with a plurality of key slots 57 which are adapted to mate with the key ways 44 in the interior of the handle 26 so as to prevent the piston from rotating relative to the handle 26. It can also be seen in FIGS. 9 and 10 that the piston 46 is provided with a central threaded bore 58 which is adapted to receive the threaded shaft 52. It can thus be seen in FIG. 1 of the drawings that when the knob 54 is turned in one direction, the threaded engagement between the piston 46 and the shaft 52 will cause the piston 46 to move in one direction as the piston 46 cannot rotate; and, thus, it is subject to axial movement. When the knob 54 it turned in the opposite direction, the piston 46 will move in the opposite direction.

It can thus be seen that when the handle 26 is attached to the shank 12 of the toothbrush 10 and the piston 46 is in the far-right position, the toothpaste is ahead of it, that is, to the left of the piston 46. When the knob 54 is turned in the appropriate direction, the piston 46 will be moved to the left, compressing the toothpaste within the paste-holding cavity 43, thereby forcing the toothpaste through the threaded end 45 into the passageway 28 and through the opening 30 into the bristles 16. It can also be seen that if the valve member 36 is shifted to the right, that is, to its closed position, toothpaste will be prevented from being ejected into the bristles 16. If the valve member 36 is moved to the left as illustrated in FIG. 1 of the drawings, the opening 30 will be opened and the toothpaste will flow freely into the bristles 16.

It can thus be seen that applicant has provided a new and improved toothbrush having a toothpaste dispenser attached thereto which is of simple design, economical to manufacture and simple to use.

It should be apparent to those skilled in the art of toothbrushes that other forms of the present invention may be had, all coming within the spirit of the invention and the scope of the appended claims.

What is claimed is as follows:

1. A toothbrush having a toothpaste storage capacity, said toothbrush comprising:

a one piece shank having a head portion;

a plurality of bristles attached to the head portion, said shank and said head portion having a passageway extending therethrough, said passageway having a discharge orifice at one end proximal to said bristles, a rectangularly shaped guide bore extending between said orifice and an outer end thereof including an enlarged intermediate portion, the other end of said passageway opening at the end of said shank, said opening being threaded;

a handle having a flanged end portion slidingly engaging said threaded shank end, said handle being hollow and having a toothpaste storing cavity therein and adapted to communicate said toothpaste through said shank passageway to the discharge orifice at the head portion of said shank;

a one piece rectangular valve stem member in said head portion slidingly engageable with and complementary to said guide bore movable between a first position opening said discharge orifice, permitting communication of said toothpaste to said bristles, to a second position, closing said communication, a raised tab integral with the stem movable within the enlarged section, an enlarged member handle, the member handle abutting the head portion to define the second position and the tab abutting a wall of the enlarged portion to define the first position;

a threaded shaft, one end of said threaded shaft being mounted to an end of said handle so as to rotate said shaft about the longitudinal axis of said handle;

said knob including a pair of opposed snap members to lockingly engage an inside surface of said handle retaining said knob longitudinally;

a piston means having a central aperture engaging said threaded shaft; and means on the interior of said handle for engaging said piston to prevent rotation of said piston relative to said housing, whereby rotation of said shaft causes axial movement of said piston within said toothpaste holding cavity so as to force said toothpaste therein to said passageway and through said discharge orifice.

2. The toothbrush defined in claim 1 further comprising means in said cavity for forcing said toothpaste therein under pressure into said passageway.

3. The toothbrush defined in claim 2 wherein said last-mentioned means comprises:

a threaded shaft, one end of said threaded shaft being mounted cantilever style to a knob, said knob being mounted to an end of said handle so as to rotate said shaft about the longitudinal axis of said handle;

a piston means having a central aperture engaging said threaded shaft;

means on the interior of said handle for engaging said pistons to prevent rotation of said piston relative to said housing, whereby rotation of said shaft causes axial movement of said piston within said toothpaste holding cavity so as to force said toothpaste therein to said passageway and through said discharge orifice.

* * * * *